United States Patent [19]

Bieu, Sr.

[11] 3,948,174

[45] Apr. 6, 1976

[54] DEVICE FOR PREVENTING MALFUNCTION OF INK PICK-UP ROLLERS IN OFFSET PRINTING PRESSES

[75] Inventor: Earl C. Bieu, Sr., Phoenix, Ariz.

[73] Assignee: Wallace J. Baker, Jr., Phoenix, Ariz.

[22] Filed: Mar. 1, 1972

[21] Appl. No.: 230,688

[52] U.S. Cl. ..... 101/350; 101/DIG. 6

[51] Int. Cl.[2] ..... B41L 27/16

[58] Field of Search ..... 101/DIG. 6, 349–352, 101/356, 357, 360, 361, 363, 206, 207, 209, 148; 248/15, 16, 188.4, 354 S

[56] References Cited

UNITED STATES PATENTS

| | | | |
|---|---|---|---|
| 840,770 | 1/1907 | Ives | 248/354 S |
| 1,612,124 | 12/1926 | Huelsick | 248/354 S |
| 1,708,413 | 4/1929 | Fowler | 248/354 L |
| 1,723,970 | 8/1929 | Jauch | 248/354 S |
| 2,232,112 | 2/1941 | Hubbell et al. | 248/354 S |
| 2,474,160 | 6/1949 | Peyrebrune | 101/DIG. 6 |
| 2,684,222 | 7/1954 | Miller | 248/354 S |

*Primary Examiner*—J. Reed Fisher
*Attorney, Agent, or Firm*—Charles E. Cates

[57] ABSTRACT

Means are disclosed for preventing the sticking of the ink pick-up roller on an offset printing press when using heavier bodied inks. The ink pick-up roller is prevented from malfunctioning by bracing the ink pick-up bar to force the cam to operate the cam follower on the ink pick-up bar as a lever instead of pushing it away.

4 Claims, 2 Drawing Figures

DEVICE FOR PREVENTING MALFUNCTION OF INK PICK-UP ROLLERS IN OFFSET PRINTING PRESSES

BACKGROUND OF THE INVENTION

In the smaller type of offset printing press popular with printing shops serving local needs, such as those manufactured by the A. B. Dick Company Model 360, and the Addressograph Multigraph multilith 220, a vexing problem in the ink feed mechanism has existed since these presses appeared on the market. The ink adapter roller sticks to the fountain roller when using the heavier bodied more viscous inks.

When the ink adapter roller sticks as described it becomes necessary for the operator to continuously assist the operation by hand to free the ink pick-up roller. This requires much time and attention by the operator and it is very difficult for one man to operate the press under these conditions. Two men are required for a practical operation of a press. There arose, therefore, a need for means of overcoming this problem in such smaller offset presses, hundreds of thousands of which are presently in use throughout the country.

One method devised for overcoming the problem involves an expensive (on the order of $35 per press) alteration of the press by a skilled repairman who must replace or augment the single center cam and cam follower with two cams and cam followers disposed at the ends of the bars which carry them. The correction of the problem by this means requires taking the ink feed mechanism apart, resulting in press down rime and consumption of a skilled repairman's time. Thus, there still exists a need for an alternative means for correcting the problem which could be installed in the machine by unskilled help, or which could be installed by a repairman more conveniently and more quickly than the presently known alternative..

Accordingly it is an object of this invention to provide a simple, convenient, rugged, inexpensive, easily and quickly installed device and method which will correct the problem described.

BRIEF DESCRIPTION OF THE INVENTION

I have discovered that the problem with the offset presses of the type described can be overcome by utilizing means for bracing the ink pick-up bar near the site of the cam follower to prevent the bending of the bar, at that point, away from the cam. An efficient means, which is very simple for an unskilled person to install in the press, is a body having spaced forked projections, or fingers, at each end. One fork pivotally engages the outer surface of the cylindrical ink pick-up bar and the other fork engages any convenient part of the press capable of giving the required suppport. Conveniently the means comprises a threaded bolt having loose fitting linearly adjustable fingers disposed at each end, one set of fingers formed to fit the radius of curvature of the pick-up bar and the other set fashioned to fit a nearby support bar in the press, and a plurality of nuts for adjusting the spaced fingers and retaining them in place after adjustment.

A method for preventing the sticking of the ink pick-up roller to the ink fountain roller when using heavy bodied inks in offset printing presses of the type described is to brace the ink pick-up bar against movement away from the cam to force the cam to operate the cam follower instead of displacing the ink pick-up bar.

DETAILED DESCRIPTION OF THE PREFERRED EMBODIMENT OF THE INVENTION

Figure 1:
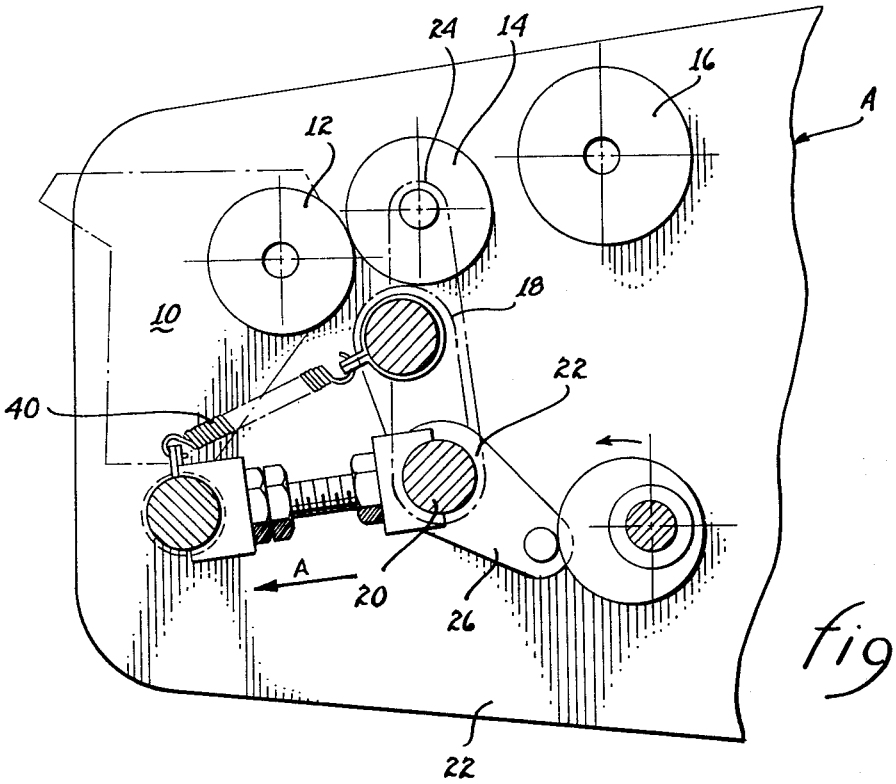
FIG. 1 is a portion of an offset printing press of the type sold by A. D. Dick Company as Model 360, showing the pertinent part of the ink feed mechanism and the invention in operative relationship thereto.
Figure 2:
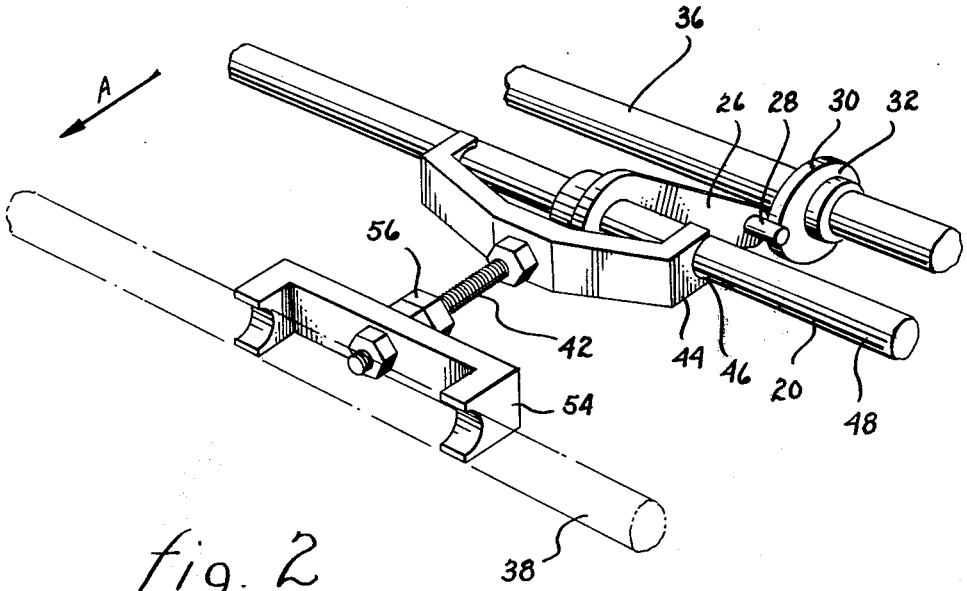
FIG. 2 is a perspective view of the device of this invention.

In the drawings FIG. 1 shows a portion 2 of an offset printing press. This portion 2 contains the part of the feed mechanism which creates the problem solved by this invention. The fountain 10 contains a reservoir of ink to be carried to the printing plate in desired amounts. The fountain roller 12 rotates, making continuous contact with the ink in the fountain 10. In order to convey discrete desired amounts of ink to the plate instead of a continuous ungovernable stream of ink, an ink pick-up roller 14 is provided which oscillates back and forth between the fountain roller 12 and the press roller 16. The press roller 16 is continuously rotating and conveys the ink picked up from the ink pick-up roller 14 to other rollers (not shown) which in turn transfer the ink to each other and to the ultimate destination. It is operation of the ink pick-up roller 14 which creates the problem. The ink pick-up roller 14 is connected by means of arms 18 which are connected to the ends of the ink pick-up roller 14 and extend to the ink pick-up bar 20. The cam follower 26 is rigidly attached to the ink pick-up bar 20 near the center thereof. The cam follower 26 has a cam follower pin 28 which rides the perimeter 30 of the cam 32. The ink pick-up bar pivots about its own axis in response to the action of the cam upon the cam follower. The ends of the ink pick-up bar 20 are pivotally engaged by a portion of the frame 22 of the press. The arms 18 are rigidly attached to the ink pick-up bar 20 at positions spaced from the ends 22 and the other ends 24 rotatably engage the ends of the ink pick-up roller 14. This motion normally oscillates the radially extending arms 18 which in turn cause the ink pick-up roller 14 to oscillate in a short arc, shuttling between the fountain roller 12 and the press roller 16. The spring 40 is for the purpose of returning the ink pick-up bar 14 to the fountain roller 12 after the action of the cam has moved the ink pick-up roller 14 to the press roller 16.

When using the more viscous heavier bodied inks the ink pick-up roller 14 sticks to the fountain roller 12 and the operation of the cam 32 upon the cam follower pin 28 forces the flexible ink pick-up bar 20 away from the cam rod 36 toward the support bar 38 instead of pivoting the ink pick-up bar 20. To prevent the flexion and consequent displacement of the ink pick-up bar 20, a brace having a body 42 and projecting fingers 44 and 54 is provided. The fingers 44 have arcuate receptacles 46 having a radius of curvature corresponding to the ink adapter bar 20 in order to engage the outer surface 48 of the ink adapter bar 20 and also permit the ink adapter bar 20 to pivot. The projecting fingers 54 at the other end of the body 42 engage a support bar 38. In this preferred embodiment the body 42 is a bolt 42. The fingers have apertures (not shown) larger than the bolt's circumference. Alternatively the aperture can be threaded to receive the bolt. Nuts 56 are provided for adjusting the space between the fingers 44 and 54 to assure a firm, precise locking fit. Thus the ink adapter bar 20 is prevented from moving in the direction of the arrow "A" and the full force of the cam is asserted against the cam follower and is transmitted into torque sufficient to overcome the grip of the viscous heavier bodied inks, thus preserving the normal operation to the ink adapter roller.

The parts of the device are easily fabricated and may be conveniently provided in the form of a kit for modifying the offset presses of the type described. Unskilled persons may easily assemble the device in place with practically no press down time. Expensive repairs are avoided and scarce repairmen are freed for more demanding tasks. Because of its simplicity of construction the device of this invention is rugged and durable and convenient to install and use. Little, if any, maintenance of the device is required. Occasional adjustments can be made conveniently by the operator as needed.

It will become apparent to those skilled in the art that other equivalent means for accomplishing the function of this device can be resorted to without departing from the spirit and scope of the invention.

Having fully described my invention I claim:

1. In an offset printing press having an ink feed mechanism supported by the frame thereof comprising an ink pick-up roller which transfers ink from a fountain ink roller to a press roller, the ink pick-up roller being connected to and actuated by a flexible ink pick-up bar having near its midpoint a cam follower responsive to a cam, the improvements comprising means for bracing the ink pick-up bar at the cam follower to prevent the cam from pushing away the ink pick-up bar when said ink pick-up roller is stuck to said fountain ink roller by viscous ink.

2. The device of claim 1 wherein said means for bracing the ink pick-up bar comprises a body having means for rotatably engaging the pick-up bar and means for anchoring said body in place, whereby movement of the pick-up bar away from the cam is prevented and the ink pick-up bar is free to rotate under the influence of said cam arrangement.

3. The device of claim 2 wherein said means for rotatably engaging the ink pick-up bar is a plurality of fingers shaped to receive the outer surface of the cylindrical ink pick-up bar, and said means for anchoring said body in place is a finger shaped to engage a support bar attached to said frame.

4. The device of claim 2 wherein said means comprises a bolt having threaded ends, a first finger adapted to rotably engage the ink pick-up bar, a second finger adapted to engage a support bar spaced from said ink pick-up bar, said fingers having apertures for receiving said bolt and a plurality of nuts sized to fit said bolt for retaining said fingers in a desired spaced relationship on said bolt.

* * * * *